United States Patent [19]

Ohtombe

[11] Patent Number: 4,524,276

[45] Date of Patent: Jun. 18, 1985

[54] APPARATUS FOR DETECTING A SECURITY THREAD EMBEDDED IN A PAPER-LIKE MATERIAL

[75] Inventor: Ko Ohtombe, Tokyo, Japan

[73] Assignee: Tokyo Shibaura Denki Kabushiki Kaisha, Kawasaki, Japan

[21] Appl. No.: 481,944

[22] Filed: Apr. 4, 1983

[30] Foreign Application Priority Data

Apr. 6, 1982 [JP] Japan ..... 57-55993

[51] Int. Cl.[3] ..... G06K 7/10; G01J 5/08

[52] U.S. Cl. ..... 250/338; 250/339; 250/341; 356/71

[58] Field of Search ..... 250/339, 338 R, 341, 250/360.1, 359.1; 356/71

[56] References Cited

U.S. PATENT DOCUMENTS 4,239,562 12/1980 McLean ..... 156/64
4,306,151 12/1981 Chase ..... 250/341

FOREIGN PATENT DOCUMENTS 2150910 4/1972 Fed. Rep. of Germany ..... 356/71
52-11992 1/1977 Japan ..... 356/71

OTHER PUBLICATIONS

Y. Kawabata, "Infrared Sensor and Application", *Sensor Technology*, (Japan), vol. 2, No. 4, (Apr. 1982), pp. 48–50.

*Primary Examiner*—Alfred E. Smith
*Assistant Examiner*—Constantine Hannaher
*Attorney, Agent, or Firm*—Cushman, Darby & Cushman

[57] ABSTRACT

An apparatus for optically detecting a security thread embedded in a paper-like material, e.g., a paper currency. The paper-like material is carried through a detection region defined by an infrared radiation source and two infrared radiation detectors. Two optical filters are mounted on the detectors, respectively. Those filters have different infrared transmission characteristics. Therefore, one detector can detect infrared rays having wavelengths only within a specific range determined by that one filter, and the other detector can detect infrared rays having wavelengths only within another specific range determined by the other filter. When the infrared radiation source projects infrared rays to the paper-like material, the detectors deliver the respective detection signals. A processor processes these detection signals to determine whether or not a security thread is embedded in the paper-like material and also what a detected security material is made of.

11 Claims, 5 Drawing Figures

APPARATUS FOR DETECTING A SECURITY THREAD EMBEDDED IN A PAPER-LIKE MATERIAL

BACKGROUND OF THE INVENTION

This invention relates to an apparatus for detecting a security thread which is embedded in paper-like materials such as paper currencies, checks or securities for the purpose of preventing forgeries.

Copying techniques such as electrostatic copying have recently advanced to such an extent that paper currencies, checks or securities may be easily forged. Countermeasures must be taken, especially against the forgery of paper currencies. For example, a security thread, which may be an elongated nonmetal piece (e.g., a plastic piece) or an elongated metal piece (e.g., an aluminum piece), is embedded in a paper currency. The security thread is effective in preventing forgery since the paper currency can be identified by the presence and quality of the security thread. However, accurate detection of the security thread is hard to achieve. Since a sensor must be kept in close contact with the paper currency to detect the thread by a change in the thickness of the paper money, some creases or folds will inevitably be detected as a security thread. Nor has any apparatus been proposed to distinguish a plastic security thread from an aluminum security thread, and vice versa.

SUMMARY OF THE INVENTION

It is therefore an object of the invention to provide an apparatus to correctly detect a security thread in a paper-like material even if the paper-like material has a fold or a crease.

It is a further object of the invention to provide an apparatus which can discriminate whether the security thread is made of metal or nonmetal.

According to the invention there is provided an apparatus for optically detecting a security thread embedded in a paper-like material, which comprises a radiation source for radiating infrared rays to the paper-like material; first detection means having a first filter adapted to receive the infrared rays passing through the paper-like material and to generate a first electrical signal corresponding to the amount of infrared radiation incident on the first filter; second detection means having a second filter with infrared radiation transmission characteristics different from the first filter, adapted to receive the infrared rays passing through the paper-like material and to generate a second electrical signal corresponding to the amount of infrared radiation incident on the second filter; and discrimination means connected to the first and second detection means for detecting variations of the first and second electrical signals to thereby determine whether a security thread is present in the paper-like material and what the security thread is made of.

BRIEF DESCRIPTION OF THE DRAWINGS

The invention is best understood by reference to the accompanying drawings, of which.

DETAILED DESCRIPTION OF THE PREFERRED EMBODIMENTS

Before proceeding with the preferred embodiments of the invention, the basic idea of the present invention will be summarized.

A paper-like material, e.g., a paper currency (money) with a security thread embedded therein is placed between an infrared radiation source on one hand and two infrared radiation detectors on the other. Two optical filters are mounted on these detectors. They have different infrared ray transmission characteristics. More precisely, one detector is sensitive only to the infrared rays whose wavelengths fall within a specific range, which is determined by one optical filter, and another detector is sensitive only to the infrared rays whose wavelengths fall with a different range from the former, which is determined by another optical filter. The infrared radiation source projects infrared rays to the paper-like material. Both detectors receive via the respective optical filter the infrared radiation which has passed through the paper-like material and whose wavelengths fall within the specific ranges and produce electrical signals whose levels correspond to the amounts of the received infrared rays. The paper-like material is moved in the direction perpendicular to the infrared radiation direction. When the security thread passes over the detectors, the detected signal levels become lower than that in no security thread. The security thread is thus detected. At the same time, the signal levels of the two detectors are compared with each other so as to discriminate whether the detected security thread is made of metallic or nonmetallic material.

One apparatus according to the invention, which is designed to detect a security thread in a paper currency will now be described.

Figure 1A:
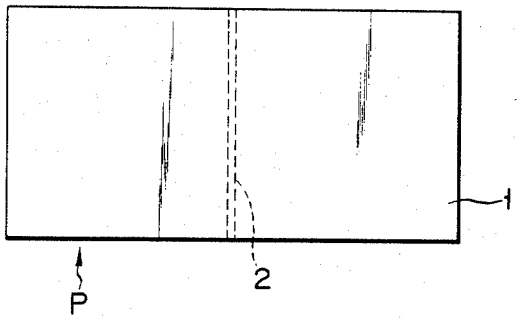
FIG. 1A is a plan view of a paper currency with a security thread embedded in it.
Figure 1B:
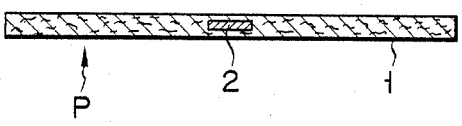
FIG. 1B is a sectional view of the paper currency shown in FIG. 1A.

FIGS. 1A and 1B show a paper money P consisting of a sheet of paper 1 and a security thread 2 embedded in the sheet 1. The security thread 2 is made of plastic, e.g., polyethylene terephthalate, or aluminum. It is about 20 microns thick, about 0.5 to 1.0 mm wide and as long as the sheet 1 is wide. The thread 2 extends in the widthwise direction of the paper money P, which is carried along its longitudinal direction.

Figure 2:
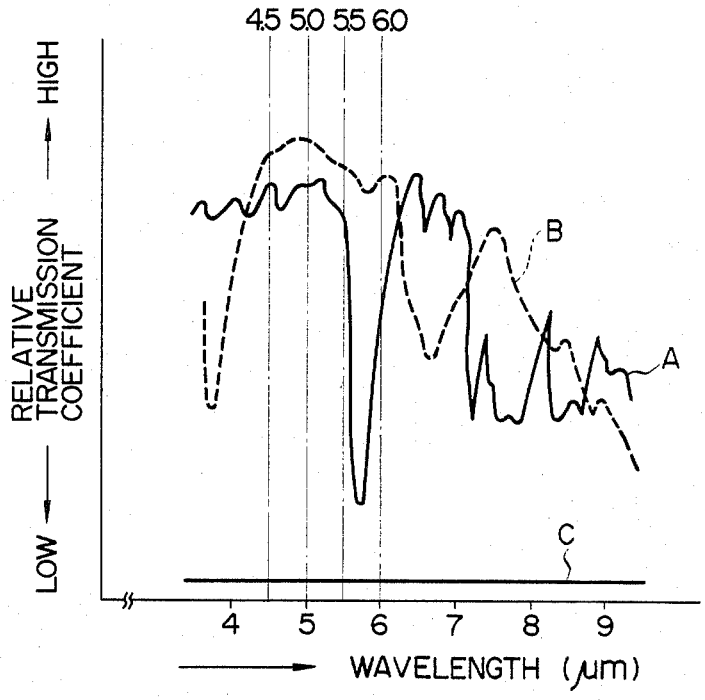
FIG. 2 is a graphic representation of the infrared transmission characteristics of a paper-like material, a plastic security thread and an aluminum security thread.

FIG. 2 illustrates the infrared ray transmission characteristics of the sheet 1, a plastic security thread and an aluminum security thread. More specifically, curve A indicates the transmission characteristic coefficient of the typical plastic security thread relative to the wavelength of infrared rays, curve B represents that of the paper currency relative to the wavelength of infrared rays, and line C shows that of the aluminum security thread relative to the wavelength of infrared rays.

Figure 3:
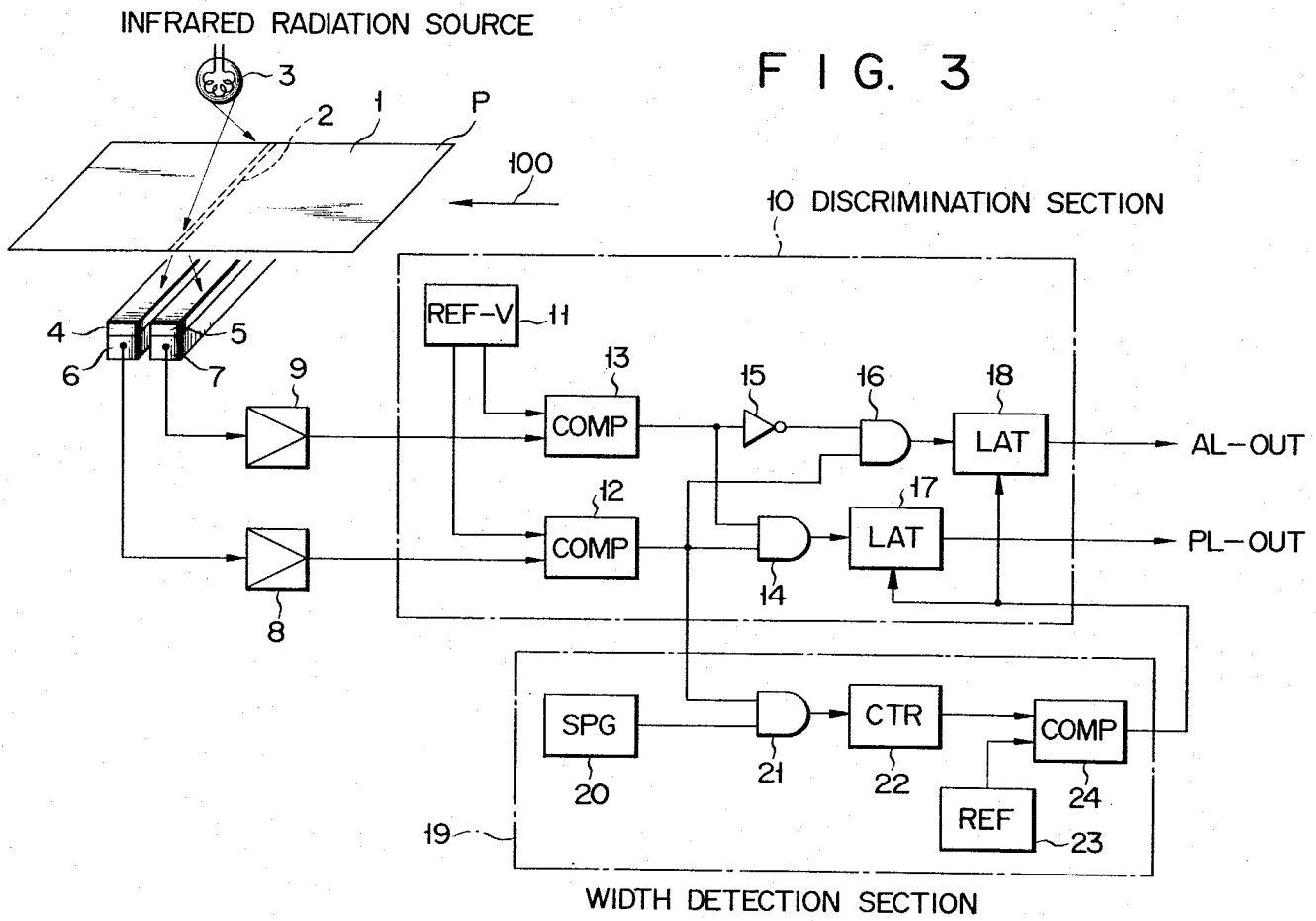
FIG. 3 is a block diagram of one embodiment of the present invention.

FIG. 3 shows an apparatus according to the invention. The paper money P is carried by a conveyor belt (not shown) in the direction of an arrow 100 (longitudinal direction of the paper money), while being held tautly by a pair of members (not shown) which clamp the both ends of the paper money P. A security thread 2 which is embedded in the paper currency P and extends widthwise within the paper currency P is therefore at right angles to the carrying direction. An infrared radiation source 3 (e.g., an SiC light emitting element) is located above the conveyor belt (not shown) for projecting infrared rays toward the paper currency P. Two infrared band-pass filters 4 and 5 are positioned below the conveyor belt and arranged side by side along the conveyor belt, to thereby receive infrared rays transmitting from the infrared radiation source 3 through the paper currency P. One filter 4 passes only infrared rays which have wavelengths of 5.5 to 6.0 microns and which are well absorbed by plastics. The other filter 5 passes only infrared rays which have wavelengths of 4.5 to 5.0 microns and which are scarcely absorbed by paper as well as plastics. Hence, the filters 4 and 5 are designed to have very different filtering characteristics. Both filters 4 and 5 are elongated rectangular shapes. Two infrared radiation detecting elements 6 and 7 (e.g., InSb elements), which are also rectangular plates, are attached to the lower faces of the filters 4 and 5, respectively. The elements 6 and 7 detect infrared rays passing through the filters 4 and 5 and convert these rays into electrical signals. The filters 4 and 5 and the elements 6 and 7 extend at right angles to the conveyor belt (not shown) and are as long as the security thread 2. If they are too long, the detection signals from the elements 6 and 7 may have a poor S/N ratio.

The electrical signal from the first detector element 6 is amplified by a amplifier 8 and then supplied to a discrimination section 10. The signal from the second detector element 7 is also amplified by an amplifier 9 and then supplied to the discrimination section 10. The discrimination section 10 is designed to determine whether or not a security thread 2 is embedded in the paper currency P and whether the security thread 2 is made of metallic or nonmetallic material. The section 10 comprises a reference voltage generator 11 (e.g., a DC power source) for delivering first and second reference voltages, a first analog comparator 12 for comparing the signal from the amplifier 8 with the first reference voltage from the generator 11, a second analog comparator 13 for comparing the signal from the amplifier 9 with the second reference voltage from the generator 11, an AND circuit 14 for obtaining the logical product of output signals from the two comparators 12 and 13, an inverter circuit 15 for inverting the output signal from the second comparator 13, an AND circuit 16 for obtaining the logical product of output signals from the first comparator 12 and inverter circuit 15, and first and second latch circuits 17 and 18 for latching output signals from the AND circuits 14 and 16, respectively. The latch circuits 17 and 18 deliver their contents in response to a truth signal supplied from a width detection section 19 which will be described later. It should be noted that the first reference voltage is usually different from the second reference voltage, but the former is equal to the latter in the specific case.

An output signal from the first comparator 12 is supplied to the width detection section 19. The section 19 is designed to detect the width of a security thread. When the width of the security thread is determined to be equal to the standard one, the width detection section 19 produces and supplies a truth signal simultaneously to the latch circuits 17 and 18. The section 19 comprises a sampling pulse generator 20, an AND circuit 21 for obtaining the logical product of a sampling pulse from the generator 20 and the output signal from the first comparator 12, a counter 22 for counting output signals from the AND circuit 21, a reference value generator 23 for delivering the digital reference value corresponding to the standard one, and a digital comparator 24 for comparing counts of the counter 22 with the reference value originated from the reference value generator 23.

The operation of the apparatus shown in FIG. 3 will now be described. Assume any portion of the paper currency P in which no security thread is embedded lies in the projection area defined by the infrared radiation source 3 on one hand and the infrared radiation detectors 6 and 7 on the other. Since the paper currency P has a relatively high transmission coefficient for infrared rays having wavelengths of 4.5 to 5.0 microns and 5.5 to 6.0 microns, as indicated by curve B in FIG. 2, both detectors 6 and 7 may derive high-level electrical signals respectively. These detected signals are supplied to the first and second comparators 12 and 13 after being amplified in the amplifiers 8 and 9, respectively. The first comparator 12 compares the detected signal from the detector 6 with the first reference voltage from the reference voltage generator 11. The second comparator 13 compares the detected signal from the detector 7 with the second reference voltage. The first comparator 12 outputs a logic "0" signal when the detected signal has a level higher than the first reference voltage and a logic "1" signal when the detected signal has a level lower than the first reference voltage. Conversely, the second comparator 13 outputs a logic "1" signal when the detected signal has a level higher than the second reference voltage and a logic "0" signal when the signal has a level lower than the second reference voltage. Namely, the first and second comparators 12 and 13 are designed in such a manner that the comparison outputs have different logic levels from each other with respect to the same input signal level to the comparators. Since the output signals from both detectors 6 and 7 have a high level in the above-mentioned case, the comparators 13 and 12 output a logic "1" signal and a logic "0" signal, respectively. Hence, neither the AND circuit 14 nor the AND circuit 16 produces an output signal. The latch circuits 17 and 18 have no latching signal and thus output logic "0" signals. In this case, the discrimination section 10 determines that no security thread is embedded in that portion of the paper currency P which lies between the infrared radiation source 3 on the one hand and the detectors 6 and 7 on the other hand.

As the paper currency P is further fed in the direction of arrow 100, that portion of the paper currency P in which a security thread 2 is embedded comes to the projection region defined by the infrared radiation source 3 and the infrared radiation detectors 6 and 7. If the thread 2 is made of plastic, it considerably absorbs infrared rays having wavelengths of 5.5 to 6.0 microns. The first detector 6, which can only receive rays having wavelengths of 5.5 to 6.0 microns, outputs a low-level electrical signal. The second detector 7, which can only receive rays having wavelengths of 4.5 to 5.0 microns, still outputs the high-level electrical signal. In this case, both comparators 12 and 13 output logic "1" signals and the AND circuit 14 outputs a logic "1" signal. The first latch circuit 17 latches this logic "1" signal from the AND circuit 14. This latch circuit 17 delivers the logic "1" signal as an indication of the plastic thread signal PL-OUT when the width detection section 19 sends the truth signal.

If the thread 2 is made of aluminum, both detectors 6 and 7 produce low-level electrical signals since the infrared rays from the infrared radiation source 3 can hardly pass through the aluminum security thread 2 as indicated by line C in FIG. 2. In this case, the comparators 12 and 13 output a logic "1" signal and a logic "0" signal, respectively. Therefore, only the AND circuit 16 produces a logic "1" signal. Then the second latch circuit 18 latches this logic "1" signal and delivers this signal as an indication of the aluminum thread signal AL-OUT when the width detection section 19 produces the truth signal.

As described above, the discrimination section 10 compares the output signals from the infrared radiation detectors 6 and 7 with a predetermined reference value, i.e., a DC reference voltage. Depending on whether the levels of these signals are higher or lower than the relevant DC reference voltage, the discrimination section 10 determines whether or not a security thread lies in the projection (detection) region, and moreover whether a security thread, if detected, is made of plastic or aluminum.

As mentioned above, the security thread 2 is a long, thin strip which is embedded in the paper currency P and extends in the widthwise direction of the paper currency P. The width detection section 19 may detect the width of the thread 2 to determine whether or not the paper currency P is genuine, thus more effectively preventing forgery.

The operation of the width detection section 19 will now be described. Suppose that the portion of a paper currency P in which a security thread 2 made of plastic or aluminum is embedded lies in the detection region defined by the infrared radiation source 3 on the one hand and the detectors 6 and 7 on the other. The output signal from the first amplifier 8 therefore has a low level. The first comparator 12 then outputs a logic "1" signal. The AND circuit 21 obtains the logical product of the logic "1" signal from the comparator 12 and the sampling pulse from the sampling pulse generator 20 and therefore produces an output signal. The output signal from the AND circuit 21 is supplied to the counter 22. In other words, the AND circuit 21 samples the comparison signal from the first comparator 12 with the sampling pulse when the comparison signal becomes logic "1" level and supplies a sampling output signal to the counter 22. The counter 22 counts output signals from the AND circuit 21, i.e., sampling output signal pulses, and supplies a signal representing the count to a third digital comparator 24. The third comparator 24 compares the count of the counter 22 with the reference value supplied from the reference value generator 23 and having the digital value corresponding to the standard width of the security thread 2. If the count of the counter 22 is equal to the reference value, the digital comparator 24 produces a logic "1" signal, i.e., a truth signal. Since the comparison output in the period during which the level of the output signal from the amplifier 8 is low, i.e., the period during which the detector 6 detects the security thread 2, is sampled with sampling pulses, the number of sampling pulses from the AND circuit 21 is proportional to the width of the security thread 2. Hence, if the counts of the counter 22 is equal to the reference digital value, the width of the security thread 2 can be judged to be the standard width or a genuine security thread and thus the digital comparator 24 outputs a truth signal.

Another embodiment of the invention will now be described with reference to FIG. 4. Based upon the principle operation of this embodiment, the difference between the two output signals from the first and second infrared radiation detectors 6 and 7 is calculated to thereby discriminate a plastic security thread 2 and the sum of those output signals is computed to discriminate aluminum security thread 2.

Figure 4:
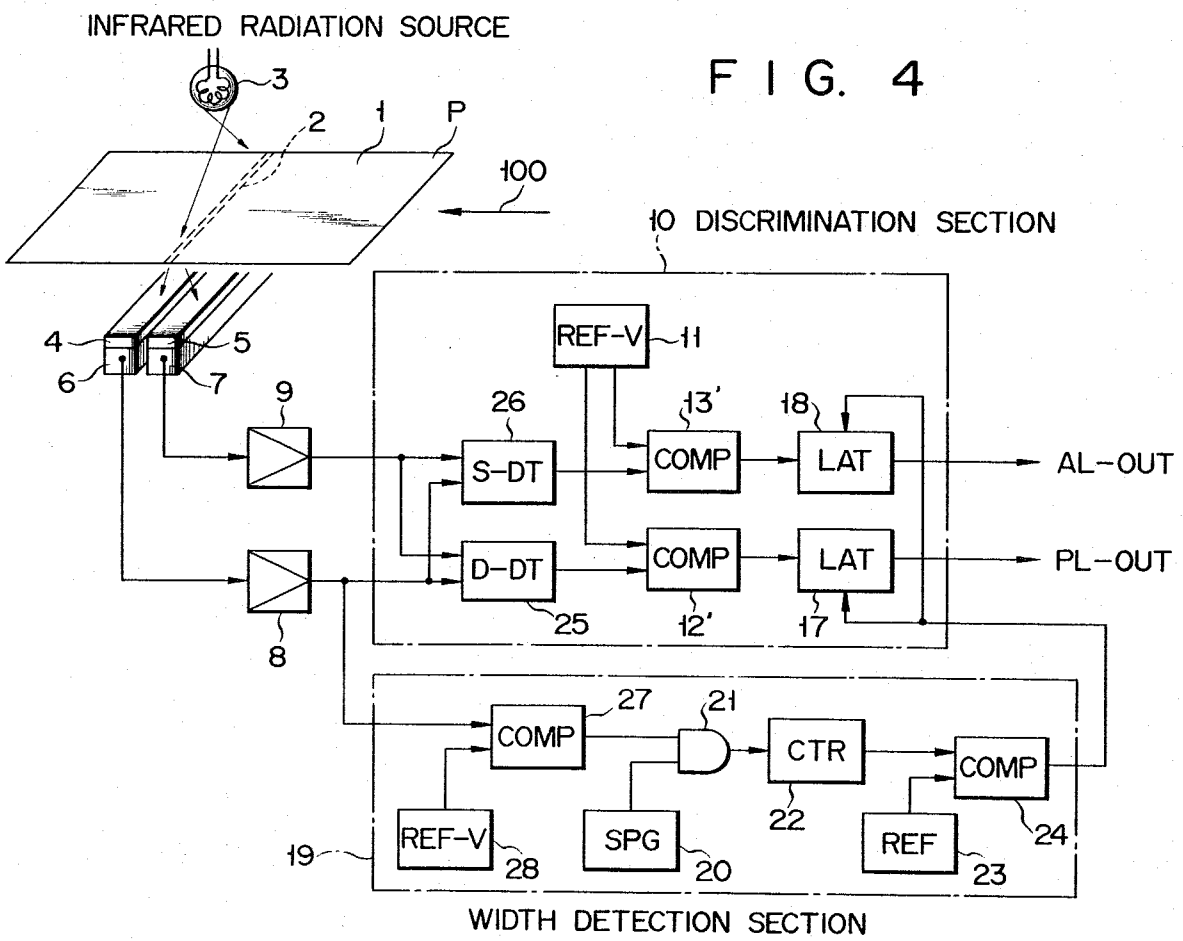
FIG. 4 is a block diagram of another embodiment of the present invention.

It should be noted that the same reference numerals shown in FIG. 3 will be employed as those for denoting the same circuit elements shown in FIG. 4. Only those components of the apparatus of FIG. 4 which are not used in the apparatus of FIG. 3 will be described in detail. The apparatus of FIG. 4 comprises mainly a discrimination section 10 as well as a width detection section 19. The discrimination section 10 comprises a difference detection circuit 25 for detecting the difference between the output signals from amplifiers 8 and 9, and a summation detection circuit 26 for detecting the sum of the output signals from the amplifiers 8 and 9. This section 10 further comprises first and second analog comparators 12' and 13' and the first and second latch circuits 17 and 18. The first analog comparator 12' is designed to compare the level of the output signal from the difference detection circuit 25 with a first reference voltage from a first reference voltage generator 11 and to produce a logic "1" signal when the output signal from the circuit 25 has a level higher than the first reference voltage, and a logic "0" signal when the signal has a level lower than the first reference voltage. The second analog comparator 13' is designed to compare the level of the output signal from the summation detection circuit 26 with a second reference voltage from a reference voltage generator 11 and to produce a logic "1" signal when the signal has a level lower than the second reference voltage, and a logic "0" signal when the signal has a level higher than the second reference voltage. It should be noted that the first reference voltage is usually different from the second reference voltage, but the former is equal to the latter in the specific case as same as in the above-mentioned first embodiment. The first latch circuit 17 is designed to latch an output signal from the first comparator 12', and the second latch circuit 18 to latch an output signal from the second comparator 13'. The width detection section 19 comprises a third analog comparator 27, a second reference voltage generator 28, a sampling pulse generator 20, an AND circuit 21, a counter 22, a reference value generator 23 and a digital comparator 24. The third analog comparator 27 is designed to compare a level of an output signal from the amplifier 8 with a third reference voltage from the second reference voltage generator 28 and to produce a logic "1" signal when the signal has a level lower than the third reference voltage, and a logic "0" signal when the signal has a level equal to or higher than the third reference voltage. The AND circuit 21 is designed to obtain the logical product of an output signal from the third comparator 27 and a sampling pulse from the sampling pulse generator 20.

The operation of the apparatus shown in FIG. 4 will now be described. Suppose any portion of a paper currency P in which no security thread is embedded lies in the detection region defined by an infrared radiation source 3 and infrared radiation detectors 6 and 7. Both detectors 6 and 7 output high-level electrical signals. The difference detection circuit 25 therefore outputs a low-level signal, whereas the summation detection circuit 26 outputs a high-level signal as a result of the calculation. Both analog comparators 12' and 13' then produce logic "0" signals. Neither the first latch circuit 17 nor the second latch circuit 18 latches any output signal from the comparators 12′ and 13′.

Assume that a portion of a paper currency P in which a plastic security thread 2 is embedded is in the above-mentioned detection region. The amplifiers 8 and 9 output a low-level signal and a high-level signal, respectively. Both detection circuits 25 and 26 therefore output high-level signals. The comparator 12′ produces a logic "1" signal, whereas the comparator 13′ produces a logic "0" signal. Hence, the latch circuit 17 delivers a plastic security thread signal PL-OUT.

Suppose that a portion of a paper currency P in which an aluminum security thread is embedded lies in the detection region defined by the infrared radiation source 3 and the detectors 6 and 7. In this case, both amplifiers 8 and 9 produce low-level signals. Both detection circuits 25 and 26 therefore produce low-level signals. The comparator 12′ produces a logic "0" signal, whereas the comparator 13′ produces a logic "1" signal. The latch circuit 18 therefore outputs an aluminum security thread signal AL-OUT.

As described above, in the apparatus of FIG. 4 both the difference between the output signals from the detectors 6 and 7, and the sum of these output signals are calculated, and the difference and sum thus calculated are compared with predetermined relative reference values, thereby easily detecting the presence of a security thread 2 in a paper currency P and easily discriminating whether the thread 2 is made of plastic or aluminum.

All circuits and components used in the apparatus described above are known and commercially available. The relationship between the components of the invention and the commercially available components is as follows:

In First Embodiment (FIG. 3)

| | |
|---|---|
| Amplifiers 8, 9 | TA 7504P |
| Comparators 12, 13 | LM 311 |
| Inverter 15 | SN 74LS04 |
| AND Circuits 14, 16, 21 | SN 74LS08 |
| Latch Circuits 17, 18 | SN 74LS74 |
| Counter 22 | SN 74LS393 |
| Comparator 24 | SN 74LS85 |

In Second Embodiment (FIG. 4)

| | |
|---|---|
| Amplifiers 8, 9 | TA 7504P |
| Comparators 12′, 13′ | LM 311 |
| AND Circuit | SN 74LS08 |
| Latch Circuits 17, 18 | SN 74LS74 |
| Counter 20 | SN 74LS393 |
| Comparator 24 | SN 74LS85 |
| Difference Detector CKT | TA 7504P and a resistor |
| Summation Detector CKT | TA 7504P and a resistor |

It should be noted that the comparators 12′ and 13′ are completely identical to the comparators 12 and 13, but only difference is how to operate them in each embodiment, and in both embodiments described above the reference voltage generator 11 can be comprised of, for example, a series circuit of a resistor and a Zener diode connected to a DC source and a variable resistor connected in parallel to the Zener diode. The reference voltage is supplied from the sliding terminal of the variable resistor.

The apparatus according to the invention is advantageous in the following respects. First, it can reliably detect a security thread in a paper currency even if the paper currency has wrinkles and/or folds, since the detectors are spaced apart from the paper currency. Second, it can discriminate whether or not a security thread, when detected, is made of metallic or nonmetallic material.

While the invention has been described in terms of certain preferred embodiments and exemplified with respect thereto, those skilled in the art will readily appreciate that various modifications, changes, omissions and substitutions may be made without departing from the spirit of the invention.

The infrared band-pass filters and infrared radiation detectors are not limited to rectangular ones, they may also be square. Further, more than two filters and more than two detectors may be arranged side by side in the widthwise direction of a security thread embedded in a paper currency and the electrical signals from the three or more detectors may be processed to achieve the same effects as in the embodiments described above.

Moreover, the apparatus according to the invention can detect not only security threads embedded in paper currencies but also those embedded in checks or securities.

What is claimed is:

1. An apparatus for optically detecting a security thread embedded in a paper-like material, comprising:
   - a radiation source for irradiating infrared rays to illuminate the paper-like material;
   - first detection means having a first filter adapted to selectively receive the infrared rays passing through the paper-like material and to deliver a first detection signal corresponding to the amount of infrared radiation incident onto the first detection means;
   - second detection means having a second filter with infrared radiation transmission characteristics different from the first filter, adapted to selectively receive the infrared rays passing through the paper-like material and to deliver a second detection signal corresponding to the amount of infrared radiation incident onto the second detection means; and
   - processing means connected to the first and second detection means for processing variations between the first and second detection signals so as to determine whether the security thread is present in the paper-like material and also what the security thread is made of.

2. An apparatus as claimed in claim 1, wherein said processing means includes:
   - a reference voltage source for delivering first and second reference voltages;
   - a first comparator for comparing the first detection signal with the first reference voltage applied from the reference voltage source to derive a first comparison signal;
   - a second comparator for comparing the second detection signal with the second reference voltage applied from the reference voltage source to derive a second comparison signal; and
   - a determining circuit for processing the first and second comparison signals from the first and second comparators to determine the presence of the security thread in the paper-like material and to determine what the security thread is made of.

3. An apparatus as claimed in claim 2, wherein said determining circuit includes:

a first AND gate having two inputs connected to receive the first and second comparison signals from the first and second comparators;

a second AND gate having one input connected to receive the second comparison signal from the second comparator via an inverter and having another input connected to receive the first comparison signal from the first comparator;

a first latch circuit connected to the output of the first AND gate for delivering a first output signal indicating one material of the security thread; and a second latch circuit connected to the output of the second AND gate for delivering a second output signal indicating another material of the security thread, said first and second latch circuits only delivering a signal when said security thread is present in the paper-like material.

4. An apparatus according to claim 3, further comprising third detection means having an input connected to one of the first and second comparators for receiving one of the first and second comparison signals from one of the first and second comparators, having an output connected to control gates of the first and second latch circuits and which detects the width of the security thread by measuring the duration of one of the first and second comparison signals from the first and second comparators, thereby controlling the delivery of the first and second output signals from the latch circuits.

5. An apparatus as claimed in claim 1, wherein said security thread is a strip embedded in the paper-like material in a direction perpendicular to a conveying path along which the paper-like material is transported.

6. An apparatus as claimed in claim 5, wherein said first and second detection means are positioned in direction perpendicular to the conveying path, and have substantially the same length as said security thread.

7. An apparatus for optically detecting a security thread embedded in a paper-like material, comprising:

a radiation source for irradiating infrared rays to illuminate the paper-like material;

first detection means having a first filter adapted to selectively receive the infrared rays passing through the paper-like material and to deliver a first detection signal corresponding to the amount of infrared radiation incident onto the first detection means;

second detection means having a second filter with infrared radiation transmission characteristics different from the first filter, adapted to selectively receive the infrared rays passing through the paper-like material and to deliver a second detection signal corresponding to the amount of infrared radiation incident onto the second detection means; and processing means connected to the first and second detection means for calculating the difference between the first and second detection signals and the sum of the first and second detection signals from the first and second detection means so as to determine whether a security thread is present in the paper-like material and what the security thread is made of.

8. An apparatus as claimed in claim 7, wherein said processing means includes:

a reference voltage source delivering first and second reference voltages;

a difference detection circuit for calculating the difference between the first and second detection signals;

a sum detection circuit for calculating the sum of the first and second detection signals;

a first comparator for comparing a difference signal from the difference detection circuit with the first reference voltage from the reference voltage source;

a second comparator circuit for comparing a sum signal from the sum detection circuit with the second reference voltage from the reference voltage source;

a first latch circuit connected to the output of the first comparator for delivering a first output signal indicating one material of the security thread; and a second latch circuit connected to the output of the second compartor for delivering a second output signal indicating another material of the security thread, said first and second latch circuits only delivering a signal when said security thread is present in the paper-like material.

9. An apparatus as claimed in claim 8, further comprising third detection means having an input connected to one of the first and second detection means for receiving one of the output signals from one of the first and second detection means, having an output connected to control gates of the first and second latch circuits, said third detection means detecting the width of the security thread by measuring the duration of one of the first and second detection signals from the first and second detection means, thereby controlling the delivery of the first and second output signals from the determining circuit.

10. An apparatus as claimed in claim 7, wherein said security thread is a strip embedded in the paper-like material in a direction perpendicular to a conveying path along which the paper-like material is transported.

11. An apparatus as claimed in claim 10, wherein said first and second detection means are positioned in a direction perpendicular to the conveying path, and have substantially the same length as said security thread.

* * * * *